United States Patent [19]

Vallarino et al.

[11] Patent Number: 4,990,435

[45] Date of Patent: Feb. 5, 1991

[54] SILVER HALIDE PHOTOGRAPHIC ELEMENT, PHOTOGRAPHIC COATING COMPOSITION AND PROCESS TO PREPARE AN AQUEOUS DISPERSION OF A HYDROPHOBIC COMPOUND

[75] Inventors: Angelo Vallarino; Mauro Besio; Lorenzo Vittore, all of Savona, Italy

[73] Assignee: Minnesota Mining and Manufacturing Company, St. Paul, Minn.

[21] Appl. No.: 940,903

[22] Filed: Dec. 10, 1986

[30] Foreign Application Priority Data

Dec. 20, 1985 [IT] Italy ..... 23302 A/85

[51] Int. Cl.[5] ..... G03C 5/18

[52] U.S. Cl. ..... 430/546; 430/512; 430/517; 430/631

[58] Field of Search ..... 430/512, 517, 631, 546

[56] References Cited

U.S. PATENT DOCUMENTS

| | | | |
|---|---|---|---|
| 3,547,899 | 12/1970 | Arlt et al. | 260/79.3 |
| 4,199,363 | 4/1980 | Chen | 430/512 |
| 4,368,258 | 1/1983 | Fujiwhara et al. | 430/631 |

*Primary Examiner*—Jack P. Brammer

*Attorney, Agent, or Firm*—Donald M. Sell; Walter N. Kirn; Mark A. Litman

[57] ABSTRACT

A polymeric latex to load photographically useful compounds into photographic elements comprises, as a dispersed phase, fine particles of a hydrophobic polymer which, for at least 70% of its weight, comprises:

(a) repeating units derived from an ethylenic monomer containing a sulfonic or sulfonate group which monomer is capable of forming hydrophilic homopolymers, said units comprising 0.5 to 1.5% by weight of said hydrophobic polymer, (b) repeating units derived from an N-3-oxo-alkyl-substituted acrylamide, said units comprising from 5 to 25% by weight of said hydrophobic polymer, and (c) repeating units derived from acrylic acid ester monomers having a TG lower than 0° C., said units comprising at least 43.5% by weight of said hydrophobic polymer, the remaining polymer weight percentage, from zero to 30%, being formed by repeating units derived from inert monomers and/or cross-linking monomers.

Such polymeric latex can be loaded with hydrophobic compounds to obtain stable coating compositions which are suitable for a uniform dispersion in a hydrophilic layer of a photographic material.

22 Claims, No Drawings

SILVER HALIDE PHOTOGRAPHIC ELEMENT, PHOTOGRAPHIC COATING COMPOSITION AND PROCESS TO PREPARE AN AQUEOUS DISPERSION OF A HYDROPHOBIC COMPOUND

FIELD OF THE INVENTION

The present invention refers to a silver halide photographic material containing fine polymer particles loaded with a photographically useful hydrophobic compound and to a photographic coating composition comprising a polymer latex containing, as a dispersed phase, polymer particles loaded with photographically useful hydrophobic compounds.

BACKGROUND OF THE ART

Various methods have been used in the manufacture of photographic products to obtain uniform dispersions of photographically useful hydrophobic compounds, such as color forming couplers, UV-absorbing compounds, dyes and the like.

One method for dispersing a hydrophobic compound in a hydrophilic colloidal coating composition, as described in U.S. Pat. Nos. 2,304,940; 2,332,027 and 2,801,171, comprises dissolving the hydrophilic compound in oil or in a high boiling organic solvent, preferably in the presence of a low boiling auxiliary organic solvent and dispersing the resulting oily solution in a hydrophilic colloidal aqueous solution, preferably a gelatin aqueous solution, by high energy homogenizing. This method, however, requires high energy usage to obtain the required dispersion and particle sizes, which may cause an undesired degradation of the compound. Furthermore, such dispersion technique requires long times and high costs.

Research Disclosure No. 15930 of July 1977 describes a process for dispersing a hydrophobic compound in a hydrophilic coating composition by loading the hydrophobic compound onto the polymeric particles of a loading polymeric latex (for example a polymer obtained by copolymerizing an acrylic acid ester and an acrylamide with at least 2% by weight of an ethylenic monomer containing a sulfonic or sulfonate group). The resulting loaded polymer particles are dispersed in the hydrophilic colloidal coating composition without the need of high energy homogenizations. According to this process, the hydrophobic compound to be loaded is dissolved in a water-miscible organic solvent and an aqueous latex consisting of water, as a continuous phase, and of loading polymer particles, as a dispersed phase, is then blended in the water-miscible organic solvent containing the hydrophobic compound. The use of a loading polymer latex represents a substantial improvement in the art of dispersing hydrophobic compounds in the hydrophilic colloidal layers of photographic materials; the particle sizes of dispersoids containing the loaded polymer particles are lower than those obtained with oil dispersions and the use of high energy homogenization can be avoided. However, the resulting loaded latex dispersions, in general, are not stable if stored for long time periods and the hydrophobic compounds tend to crystallize and after short periods precipitate from the loaded latex. European patent No. 14,921 describes the use of polyurethane latexes to load hydrophobic compounds and form loaded latexes stable for extended times. However, only particular classes of polyurethane latexes proved to be suitable for loading and there were still unsolved problems of compatibility with the hydrophilic colloids.

SUMMARY OF THE INVENTION

According to the present invention, a polymeric latex is described for loading photographically useful hydrophobic compounds, said polymeric latex comprising, as a dispersed phase, fine particles of a hydrophobic polymer which, for at least 70% of its weight, comprises:

(a) repeating units derived from an ethylenic monomer containing a sulfonic or sulfonate group which monomer is capable of forming hydrophilic homopolymers, said units comprising from 0.5 to 1.5% by weight of said hydrophobic polymer, (b) repeating units derived from an N-3-oxo-alkyl-substituted acrylamide, said units comprising from 5 to 25% by weight of said hydrophobic polymer, (c) repeating units derived from acrylic acid ester monomers having a TG lower than 0° C., said units comprising at least 43.5% by weight of said hydrophobic polymer, the remaining polymer weight percentage, from zero up to 30%, being formed by repeating units derived from inert monomers and/or cross-linking monomers.

Said polymeric latexes can be loaded with hydrophobic polymers to obtain coating compositions stable for long time periods and suitable for uniform dispersion in a hydrophilic layer of a photographic material

DETAILED DESCRIPTION OF THE INVENTION

The present invention refers to a silver halide photographic element comprising a base and, coated on the base, one or more hydrophilic colloidal layers, at least one being a silver halide emulsion layer and at least one of said colloidal layers containing photographically useful hydrophobic compounds loaded on loading polymer particles, wherein said loading polymer, for at least 70% of its weight, comprises:

(a) repeating units derived from an ethylenic monomer containing a sulfonic or sulfonate group which monomer is capable of forming hydrophilic homopolymers, said units comprising from 0.5 to 1.5% by weight of said polymer particles, (b) repeating units derived from an N-3-oxo-alkyl-substituted acrylamide, said units comprising from 5 to 25% by weight of said polymer particles, (c) repeating units derived from acrylic acid ester monomers having a TG lower than 0° C., said units comprising at least 43.5% by weight of said polymer particles, the remaining polymer weight percentage, from zero up to 30%, being formed by repeating units derived from inert monomers and/or cross-linking monomers According to another aspect, the present invention refers to a photographic coating composition comprising, as a dispersing phase, a water solution of a hydrophilic colloid and, as a dispersed phase, hydrophobic polymer particles loaded with a photographically useful hydrophobic compound soluble in a water-miscible organic solvent, said hydrophobic polymer, up to at least 70% by weight, comprising (a) repeating units derived from an ethylenic monomer containing a sulfonic or sulfonate group which monomer is capable of forming hydrophilic homopolymers, said units comprising from 0.5 to 1.5% by weight of said hydrophobic polymer, (b) repeating units derived from an N-3-oxo-alkyl-substituted acrylamide, said units comprising from 5 to 25% by weight of said hydrophobic polymer, (c) repeating units derived from acrylic acid ester monomers having a TG lower than 0° C., said units comprising at least 43.5% of said hydrophobic polymer, the remaining polymer weight percentage, from zero up to 30%, being formed by repeating units derived from inert monomers and/or cross-linking monomers.

According to a further aspect, the present invention refers to a process to prepare a water dispersion of a (photographically useful) hydrophobic compound loaded on hydrophobic polymer dispersed particles which comprises dissolving said hydrophobic compound in a water-miscible organic solvent, blending the formed solution with a water dispersion of hydrophobic loading polymer particles and removing said water-miscible organic solvent, wherein said loading polymer is the previously defined one. In a way known to the man skilled in the art, as by blending a water solution of a hydrophilic colloid, preferably gelatin, with a water dispersion of said hydrophobic compound loaded on dispersed particles of the hydrophobic polymer of the present invention—prior to or after having removed said water-miscible organic solvent from said water dispersion—a coating composition is obtained which consists of the dispersion, in a hydrophilic colloid water solution, of a hydrophobic compound loaded on dispersed particles of the polymer of the present invention.

Preferably, the above described loading polymer comprises at least 80% by weight of said units (a), (b) and (c) wherein units (c), derived from acrylic acid ester monomers, are in a quantity of at least 53.5% by weight of said polymer. More preferably the above described loading polymer comprises at least 90% by weight of said units (a), (b) and (c), wherein units (c), derived from acrylic acid ester monomers, are in a quantity of at least 63.5% by weight. Of course, in both preferred and more preferred cases above, the remaining polymer percentage formed by inert and/or cross-linking monomers can take any value, starting from zero, up to 20 or 10, respectively.

In a specific preferred form, the ethylenic monomers capable of forming hydrophilic homopolymers, from which said repeating units (a) derive, are those corresponding to the following formula:

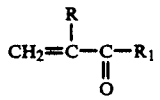

wherein R represents hydrogen or a low alkyl group having from 1 to 4 carbon atoms, $R_1$ represents an organic divalent radical which, together with the carbonyl group of the formula, forms an ester or amido linking group ending with a solubilizing group $SO_3M$, wherein M is hydrogen, ammonium or alkali metal. Specifical examples of ethylenic hydrophilic monomers useful to the present invention comprise the following compounds:

3-Acryloyloxypropane-1-sulfonic acid;
3-Methacryloyloxypropane-1-sulfonic acid;
2-Acrylamido-2-methylpropane-sulfonic acid;
3-Methacryloyloxypropane-1-methyl-1-sulfonic acid;
Acryloylmethane-sulfonic acid;
4-Acryloyloxybutane-1-sulfonic acid;
2-Acryloyloxyethane-1-sulfonic acid;
2-Acrylamidopropane-1-sulfonic acid;
2-Methacrylamido-2-methylpropane-1-sulfonic acid;
3-Acrylamido-3-methylbutane-1-sulfonic acid,
and the alkali metal salts thereof, preferably Na or K, or ammonium salts.

The N-3-oxo-alkyl-substituted acrylamide monomers, from which derive the repeating units (b) partially forming the polymer of the present invention, preferably correspond to the formula

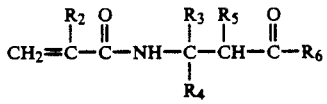

wherein $R_2$ represents hydrogen or a low alkyl group having from 1 to 4 carbon atoms and $R_3$, $R_4$, $R_5$ and $R_6$ each represents hydrogen, a low alkyl group with from 1 to 4 carbon atoms or a cycloalkyl group having a maximum of 10 carbon atoms. Specifical examples of N-3-oxo-alkyl-substituted acrylamides include:

N-3-oxopropyl-acrylamide;
N-3-oxobutyl-acrylamide;
N-3-oxo-1-methyl-butyl-acrylamide;
N-3-oxo-1-methyl-1,3-diethyl-acrylamide;
N-3-oxo-1,1-dimethyl-butyl-acrylamide (diacetone-acrylamide);
N-3-oxo-methyl-1,3-dicyclohexyl-propyl-acrylamide;
N-3-oxo-1,1-diisobutyl-2-isopropyl-5-methylhexylacrylamide;
N-3-oxo-1,1-dibutyl-2-n-propylheptyl-acrylamide;
N-3-oxo-1-methyl-butyl-α-methylacrylamide;
N-3-oxo-1,1-dimethylbutyl-α-methylacrylamide,
and the like.

The acrylic acid ester monomers, from which derive the repeating units (c) partially forming the polymer of the present invention, are preferably described as acrylic acid esters having the formula:

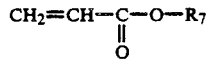

$R_7$ is an alkyl or alkoxyalkyl group having from 2 to 20 carbon atoms. Said acrylate esters have a TG lower than 0° C., this meaning that the polymers derived from said monomers have a glass transition temperature (TG), corresponding to the well-known change of a hard and brittle polymer into a soft polymer, lower than 0° C. Specifical examples of acrylate ester monomers according to the present invention include the following compounds:

sec.-butylacrylate;
n-butylacrylate;
isobutylacrylate;
2-ethylhexylacrylate;
ethylacrylate;
ethoxyethylacrylate;
hexylacrylate;
isopropylacrylate;
pentylacrylate;
octylacrylate;
tetradecylacrylate.

To the purposes of the present invention, the presence of both said repeating units (a), derived from ethylenic monomers containing a sulfonic or sulfonate group, and said repeating units (b), derived from N-3-oxo-alkylsubstituted acrylamide monomers, in combination with the repeating units (c), derived from acrylic ester monomers, proved to be essential to form the polymer of the present invention (or a substantial part thereof).

Of course, the man skilled in the art can choose within the indicated intervals the quantities which best suit his specifical needs. He can consider that to the purposes of the present invention too low quantities of repeating units (a) derived from ethylenic monomers containing a sulfonic or sulfonate group and/or repeating units (b) derived from N-3-oxo-alkyl-substituted acrylamide monomers cause problems of incompatibility between the latex and the hydrophilic binder, generally gelatin, forming the photographic layer, while excessive quantities may lead to high-viscosity latexes with problems of polymer separation or larger sizes of the dispersed polymer particles. Said inert or cross-linking repeating units are not essential or necessary to the purposes of the present invention. If they are present, for reasons of preparation or use needs, they are to be chosen so as not to negatively affect the stability, loadability and compatibility characteristics of the latexes of the present invention.

Examples of inert monomers are the ethylenic monomers (such as isoprene, 1,3-butadiene, propenenitrile, vinyl chloride, ethylene, propylene and the like), the styrene type monomers (such as styrene, vinyltoluene, chloromethylstyrene, α-methyl-styrene, 2-ethylstyrene, 1-vinylnaphthalene and the like), the 2-alkenoic acid esters (such as methyl, ethyl, propyl, butyl, hexyl, dodecyl, hexadecyl esters of methacrylic, α-ethylacrylic, α-propylacylic, 2-butenoic, 2-hexenoic, 2-methyl-2-octenoic acids and the like), the acrylamide monomers (such as acrylamide, N-methylacrylamide, N,N-dimethylacrylamide, N-butylacrylamide, N-chloromethyl-acrylamide, N-bromo-methyl-acrylamide and the like) and vinyl acetate.

In particular, repeating units derived from cross-linking monomers can prove to be useful if incorporated into the loading polymers of the present invention in order to improve the stability of the latex if stored for long time, to increase its hydrophobicity, to reduce its tendency to swell at high temperatures or in the presence of water-miscible organic solvents, to reduce the tendency of the polymeric particles to agglomerate or coagulate, to improve the abrasion resistance of the polymer particles.

A specifical class of monomers capable of forming cross-linking repeating units, to the purposes of the present invention, is represented by monomers containing two vinyl groups, preferably corresponding to the following formula:

$$CH_2{=}CH{-}R_8{-}CH{=}CH_2$$

wherein $R_8$ is a divalent organic group. The divalent group represented with $R_8$, as known in the art of the photographic hardeners, includes any divalent group of reasonable size and nature such as not to negatively affect the properties of the photographic material, preferably an aromatic or saturated cyclic hydrocarbon group having from 6 to 12 carbon atoms, such as a substituted or not substituted phenylene or cyclohexylene, or an acyclic hydrocarbon group such as an alkylene having from 1 to 8 carbon atoms, such as methylene, ethylene, trimethylene, etc. The divalent group represented by $R_8$ can also be an aralkylene (including for instance a phenylene and one or two alkylene groups attached thereto) having a total from 7 to 12 carbon atoms. At least one of the carbon atoms of the group defined above with $R_8$ can be substituted with a hetero-atom, such as nitrogen, sulfur, oxygen and/or with an organic group, such as sulfonyl, ureilene, iminocarbonyl, etc. Suitable examples of divalent organic groups include:

$$-SO_2-CH_2CH_2-O-CH_2-CH_2-SO_2-,$$

$$-SO_2-CH_2-CHOH-CH_2-SO_2-,$$
$$-CO-NH-CO-,$$

$$-CO-NH-CH_2-NH-CO-,$$
$$-SO_2-CH_2-CH_2-SO_2- \text{ and}$$

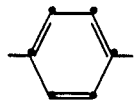

The loading polymer latexes of the present invention essentially consist of water as a continuous phase and of loading polymer particles as a dispersed phase. Said particles are typically finer as compared with the oil dispersions and similar dispersions of hydrophobic particles in hydrophilic colloid coatings. The average size of the loading polymer particles is comprised in the range from 0.02 to 0.2μ, preferably from about 0.02 to about 0.08μ. The loading polymer particles form at least 5% by weight of the aqueous latex, preferably at least 10% and more preferably about 20%.

The loading polymer latexes according to the present invention can be synthetized according to methods well-known to the man skilled in the art. They can be formed for instance by using the conventional free radical polymerization method to form organic polymeric hydrosols. Typically, the aqueous latex with the polymeric particles distributed therein can be formed by adding into water the various monomers necessary to form the desired loading polymer together with minor quantities of ingredients, such as emulsifying agents, polymerization initiators, polymerization control agents, etc., and heating the resulting mixture at a temperature ranging for instance from 40° to 90° C. under stirring for several hours. The proportions with which the monomers are loaded approximately determine the proportions of the repeating units in the loading polymer. More exactly, the proportions of the repeating units in the loading polymers can be obtained under consideration of the known differences in the monomer polymerization rates. Since however the differences introduced by such variations are not significant, said proportions are considered the proportions of the monomers introduced for the polymerization. Useful free radical polymerization techniques which can be used to prepare the loading polymer latexes of the present invention are described in U.S. Pat. Nos. 2,914,499; 3,033,833; 3,547,899 and in Canadian patent No. 704,778.

The process of loading a hydrophobic compound within the polymer particles (the expression "to load a hydrophobic compound within the polymer particles" means dissolving in or distributing on the surface of the polymer particles) is described for instance in British patent No. 1,504,950; in U.S. Pat. No. 4,199,363; in British patent application Ser. No. 2,072,365; in European patent application Ser. No. 14,921 and in Research Disclosure 15,930/1977.

According to the above mentioned publications, said processes comprise dissolving the hydrophobic compound in a low-boiling water-miscible organic solvent, such as acetone, methanol, ethanol or tetrahydrofurane, blending the solution with the loading polymer latex and then removing the low-boiling organic solvent from the mixture. The quantity of the hydrophobic compound added for loading generally ranges from 0.1 to 10 times the quantity of the polymer, preferably from 1 to 3 times. The quantity of the added low-boiling water-miscible solvent ranges from 0.1 to 1 time the whole polymer latex, but can be modified according to the composition of the polymer latex and of the used hydrophobic compound.

The polymer latex with the loaded hydrophobic compound can be incorporated into the layers of the photographic materials according to the foreseen purposes: such layers comprise silver halide light sensitive emulsion layers, protective layers, interlayers, sublayers, auxiliary layers, antihalo layers and UV absorbing layers.

The hydrophobic compounds to be loaded within the polymer latexes of the present invention comprise the substantially water-insoluble compounds which are added to the conventional silver halide photographic materials ("substantially water-insoluble" means a solubility lower than 1%). Typical examples of such compounds comprise dye forming couplers, UV-absorbing compounds, DIR compounds, bleaching agents, sensitizing dyes and developing agents. However, suitable compounds in the practice of the present invention are all the hydrophobic compounds which have been introduced into the hydrophilic colloidal layers of the photographic materials within conventional coupler solvent or similar high-boiling organic solvent droplets. Useful hydrophobic compounds which can be loaded on the latexes according to the present invention are described for instance in Research Disclosure, vol. 159, item 15,930 mentioned above.

The following examples are intended to illustrate the present invention better.

EXAMPLE 1

Latex 1 (invention)

Poly-n-butyl-acrylate-co-diacetoneacrylamide-co-2-methacryloyloxyethane-1-sulfonic acid sodium salt) (89/10/1).

A solution of 0.5 g of sodium laurylsulfate in 400 ml of water was heated at 90° C. under stirring. This solution was then added with 0.5 g of ammonium persulfate. The resulting solution, kept under continuous stirring, was then simultaneously added with a mixture of 89 g of n-butylacrylate and 10 g of diacetoneacrylamide and a solution of 1 g of 2-methacryloyloxyethane-1-sulfonic acid sodium salt in 30 ml of water. The resulting solution was kept under continuous stirring for 3 hours at 95° C. The unreacted monomers were evaporated at 80° C. for 5 hours and the resulting latex was cooled at room temperature thus obtaining 515 ml of a latex having 19% of dispersed polymer.

EXAMPLE 2

Latex 2 (invention)

Poly-(n-butylacrylate-co-diacetoneacrylamide-co-2-methacryloyloxyethane-1-sulfonic acid sodium salt) (79/20/1)

Latex 2 was prepared as described in Example 1 using 79 g of n-butylacrylate, 20 g of diacetoneacrylamide and 1 g of 2-methacryloyloxyethane-1-sulfonic acid sodium salt, thus obtaining 480 ml of latex with 20% of dispersed polymer particles.

EXAMPLE 3

Latex 3 (invention)

Poly-[n-butylacrylate-co-diacetoneacrylamide-co-2-methacryloyloxyethane-1-sulfonic acid sodium salt-co-1,3-bis-(vinylsulfonyl)-2-propanol] (87/10/2)

Latex 3 was prepared as described in Example 1 using 87 g of n-butylacrylate, 10 g of diacetoneacrylamide, 1 g of 2-methacryloyloxyethane-1-sulfonic acid sodium salt and 2 g of 1,3-bis-(vinylsulfonyl)-2-propanol thus obtaining a latex with 20% of dispersed polymer. Once isolated, the polymer resulted insoluble in common organic solvents.

EXAMPLE 4

Latex 4 (comparison)

Poly-(n-butylacrylate-co-diacetoneacrylamide-co-2-methacryloyloxyethane-1-sulfonic acid sodium salt) (69/30/1)

Latex 4 was prepared as described in Example 1 using 69 g of n-butylacrylate, 30 g of diacetoneacrylamide and 1 g of 2-methacryloyloxyethane-1-sulfonic acid sodium salt. An instable latex with large polymer separation was obtained.

EXAMPLE 5

Latex 5 (comparison)

Poly-(n-butylacrylate-co-2-methacryloyloxyethane 1sulfonic acid sodium salt) (99/1).

Latex 5 was prepared as described in Example 1 using 99 g of n-butylacrylate and 1 g of 2-methacryloyloxyethane-1-sulfonic acid sodium salt. A stable and transparent latex with 20% of dispersed polymer was obtained.

EXAMPLE 6

Latex 6 (comparison)

Poly-(n-butylacrylate-co-diacetoneacrylamide) (90/10).

Latex 6 was prepared as described in Example 1 using 90 g of n-butylacrylamide and 10 g of diacetoneacrylamide. A stable and transparent latex with 19% of dispersed polymer was obtained.

EXAMPLE 7

Latex 7 (prior art latex: L-75 latex of Research Disclosure 15,930, July 1977)

Poly-(n-butylacrylate-co-p-styrene-sulfonic acid potassium salt) (95/5) and

Latex 8 (prior art latex: L-9 latex of Research Disclosure 15,930, July 1977)

Poly-(n-butylacrylate-co-3-methacryloyloxypropane-1sulfonic acid sodium salt) (80/20).

Latexes 7 and 8 were prepared as described in Example 1 using 95 g of n-butylacrylate and 5 g of styrenesulfonic acid potassium salt (Latex 7) and 80 g of n-butylacrylate and 20 g of 3-methacryloyloxypropane-1-sulfonic acid sodium salt (Latex 8). Latexes 7 and 8 did not result stable and coagulated the polymer.

EXAMPLE 8

100 ml of latex (diluted with water up to a dispersed polymer content of 10%) were poured in a minute into a vessel containing 100 ml of acetone at room temperature under moderate stirring. Stirring was then stopped and the mixture was left to stay for 10 minutes. The latex resulted loading when not exhibiting any noticeable coagulation of the polymer particles. Latexes 1, 2 and 3 resulted perfectly loading. Latexes 5 and 6 exhibited considerable quantities of coagulated polymer after few hours.

EXAMPLE 9

A solution of 6 g of the yellow-forming coupler α-pivaloyl-α-(3-morpholino-1,2,4-triazole)-2-chloro-5-(n-hexandecanesulfonamido)-acetanilide in 80 ml of acetone was gradually added under stirring with 75 ml la Latex 1 (previously diluted with water up to a polymer content of 8%). After blending, acetone was distilled in a rotary evaporator (at 80 mm/Hg and 30° C.). No separated crystal or polymer clumping was observed at the microscope even after several day storage. The obtained coupler-loaded latex was then added to a gelatin solution showing a perfect compatibility with gelatin.

EXAMPLE 10

Example 9 was repeated using however Latex 2 as loading latex.

EXAMPLE 11

Example 9 was repeated using however 4 g of the yellow-forming coupler α-(3-morpholino-1,2,4-triazole)α-pi-valoyl-5-[(2,4-ditert.-amylphenoxy)-butyramido]-2-chloroacetanilide and 80 ml of Latex 1 (diluted with water up to a dispersed polymer content of 10%). Practically the same results were obtained.

EXAMPLE 12

Example 9 was repeated using however the magenta dye forming 1-(2',4',6'-trichlorophenyl)-3-[3-(2,4-ditert.-amylphenoxyacetamido)-benzamino]-5-pyrazolone. The resulting gelatin composition comprised 6% of coupler, 6% of polymer and 2% of gelatin.

EXAMPLE 13

Example 9 was repeated using however the magenta dye forming coupler of Example 12 and the DIR coupler 1-{4-[α-(2,4-ditert.-amylphenoxy)-acetamido]-phenyl}-3-ethoxy4-(1-phenyl-α-tetrazolylthio)5-pyrazolone. Practically the same results were obtained. The resulting dispersions comprised 3.33% of magenta coupler, 0.67% of DIR coupler, 4.00% of polymer and 2.00% of gelatin.

EXAMPLE 14

Example 9 was repeated using however the cyan dye forming coupler 2-heptafluorobutyramido-4-chloro-5-[α-(2,4-ditert.-amylphenoxy-butyramido)-phenol. Practically the same results were obtained. The resulting gelatin solution comprised 4% of coupler, 4% of polymer and 2% of gelatin.

EXAMPLE 15

A solution of 1 g of 3-dihexylaminoallylidenemalononitrile UV absorber in 50 ml of acetone was gradually added with 50 ml of Latex 1 (previously diluted with water up to a polymer content of 10%) under moderate stirring. Acetone was then removed at 30° C. to obtain a stable composition of UV-absorber-loaded latex. The latex composition was then blended with a gelatin aqueous solution resulting perfectly compatible therewith.

EXAMPLE 16

Example 15 was repeated using however 3-diallylaminoallylidenemalononitrile UV-absorber. Practically the same results were obtained.

EXAMPLE 17

The coupler-loaded composition of Example 9 was blended with a conventional blue-sensitive silver halide gelatin emulsion. The resulting emulsion was coated onto a conventional photographic base to give a layer containing the following components: 1.65 g/m² of coupler, 0.90 g/m² of silver, 2.25 g/m² of gelatin. A control element was prepared by coating the same emulsion containing the same quantity of the same coupler dispersed in a conventional coupler solvent. To disperse the coupler, the solution of the coupler in the solvent was passed many times through a colloidal mill such as a Manton-Gaulin homogenizer. Samples of the two photographic elements above were exposed and developed in a conventional manner to determine the relative speed, Dmax, gamma and Dmin values of the elements. Such values are reported in the following Table (where A refers to samples kept for 20 days at shelf life, B refers to samples stored for 22 hours at 70° C. and C refers to samples stored for 7 days at 38° C. and 75% R.H.).

TABLE 1

| | Solvent dispers. | | | Loaded latex dispers. | | |
|---|---|---|---|---|---|---|
| | A | B | C | A | B | C |
| Dmin | 0.06 | 0.05 | 0.04 | 0.06 | 0.07 | 0.05 |
| Dmax | 2.83 | 2.85 | 2.90 | 2.50 | 2.60 | 2.56 |
| Rel. speed | 1.47 | 1.58 | 1.40 | 1.52 | 1.63 | 1.36 |
| Gamma | 1.15 | 1.17 | 1.13 | 1.00 | 0.89 | 0.90 |

The above reported results show that the photographic characteristics obtained with the loaded latex composition of the present invention are comparable with those obtained with the conventional dispersion compositions.

EXAMPLE 18

The coupler-loaded latex composition of Example 12 was blended with a conventional green-sensitive silver halide gelatin emulsion. The emulsion was coated onto a conventional base to obtain a layer having the following ingredients: 0.70 g/m$^2$ of coupler, 1.8 g/m$^2$ of silver, 1.7 g/m$^2$ of gelatin. A reference material was prepared by coating the same emulsion containing the same quantity of the same coupler dispersed in a conventional coupler solvent as described in Example 17. Samples of the two photographic elements were exposed and developed in a conventional manner to determine the relative speed, Dmax, gamma and Dmin values of the elements. Such values are reported in the following table.

TABLE 2

| | Solvent dispers. | | | Loaded latex dispers. | | |
|---|---|---|---|---|---|---|
| | A | B | C | A | B | C |
| Dmin | 0.10 | 0.11 | 0.11 | 0.09 | 0.10 | 0.08 |
| Dmax | 1.92 | 1.86 | 1.80 | 1.89 | 1.86 | 1.78 |
| Rel. speed | 1.34 | 1.40 | 1.16 | 1.30 | 1.38 | 1.13 |
| Gamma | 0.90 | 0.87 | 0.80 | 0.82 | 0.88 | 0.75 |

The reported results are comparable using the two techniques of introducing the couplers into the photographic layers.

EXAMPLE 19

The coupler-loaded latex composition of Example 13 was blended with a conventional green-sensitive silver halide gelatin emulsion. The emulsion was coated onto a conventional support to give a layer having the following ingredients: 0.78 g/m$^2$ of coupler, 1.8 g/m$^2$ of silver, 1.7 g/m$^2$ of gelatin. A reference material was prepared by coating the same emulsion containing the same quantity of the same couplers dispersed in a conventional coupler solvent, as described in Example 17. Samples of the two photographic elements were exposed and developed in a conventional manner to determine the relative speed, Dmax, gamma and Dmin values. Such values are reported in the following Table.

TABLE 3

| | Solvent dispers. | | | Loaded latex dispers. | | |
|---|---|---|---|---|---|---|
| | A | B | C | A | B | C |
| Dmin | 0.11 | 0.13 | 0.14 | 0.11 | 0.12 | 0.12 |
| Dmax | 1.85 | 1.96 | 1.79 | 1.73 | 1.80 | 1.68 |
| Rel. speed | 1.26 | 1.33 | 1.18 | 1.26 | 1.29 | 1.12 |
| Gamma | 0.80 | 0.90 | 0.79 | 0.72 | 0.75 | 0.70 |

As regards the photographic characteristics the above reported results show that the loaded latex composition according to the present invention results equivalent to the conventional solvent dispersion compositions.

EXAMPLE 20

Four aqueous gelatin solutions (a to d) each containing 100 ml of 10% gelatin and respectively:

sol a 1 g of 3-dihexylaminoallylidenemalononitrile UV absorber dispersed in a conventional oil solvent;

sol. b: 1 g of 3-diallylaminoallylidenemalononitrile UV absorber dispersed in a conventional oil solvent;

sol. c: 1 g of 3-dihexylaminoallylidenemalononitrile UV absorber dispersed as described in Example 15;

sol. d: 1 g of 3-diallylaminoallylidenemalononitrile UV absorber dispersed as described in Example 16.

The four solutions were coated onto a cellulose triacetate base and the absorption curves of the four dried films (Film a to d) were recorded. The following table reports the optical density values read at 375 and 415 nm, respectively.

TABLE 4

| Film | O.D. at 375 nm | O.D. at 415 nm |
|---|---|---|
| a | 0.85 | 0.46 |
| b | 1.94 | 0.16 |
| c | 1.33 | 0.04 |
| d | 1.98 | 0.04 |

The above reported results show that a high density below 400 nm and a sharp cut off above 400 nm, as desired, is obtained with the method of the present invention.

We claim:

1. A silver halide photographic element comprising a base and, coated on the based, one or more hydrophilic colloidal layers at least one of which is a silver halide emulsion layer and at least one other of said hydrophilic colloidal layers containing photographically useful hydrophobic compounds loaded on loading polymer particles, characterized by the fact that said loading polymer for at least 70% of its weight comprises;

(a) repeating units derived from the polymerization of an ethylenic monomer containing a sulfonic or sulfonate group which monomer is capable of forming hydrophilic homopolymers, said units comprising from 0.5 to 1.5% by weight of said polymer, (b) repeating units derived from the polymerization of an N-3-oxo-alkyl-substituted acrylamide, said units comprising from 5 to 25% by weight of said polymer, and (c) repeating units derived from the polymerization of acrylic acid ester monomers having a TG lower than 0° C., said units comprising at least 43.5% by weight of said polymer, the remaining weight percentage, from zero to 30%, being formed by repeating units derived from inert monomers and/or cross-linking monomers.

2. The silver halide photographic element of claim 1 wherein the polymer particles have an average diameter in the range from 0.02 to 0.2μ.

3. The silver halide photographic element of claim 1 wherein the monomer capable of forming hydrophilic homopolymers has the formula:

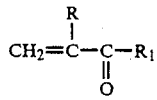

wherein R represents hydrogen or a low alkyl group having from 1 to 4 carbon atoms, $R_1$ is a divalent organic radical which, together with the carbonyl group of the formula, forms an ester or amido linking group ending in a $SO_3M$ solubilizing group, where M is hydrogen, ammonium or alkali metal.

4. The silver halide photographic element of claim 1, where the N-3-oxo-alkyl-substituted acrylamide monomer has the formula:

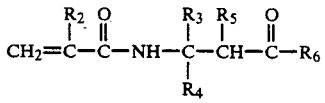

wherein $R_2$ represents hydrogen or a low alkyl group having from 1 to 4 carbon atoms, $R_3$, $R_4$, $R_5$ and $R_6$ each represents hydrogen, a low alkyl group with from 1 to 4 carbon atoms or a cycloalkyl group having a maximum of 10 carbon atoms.

5. The silver halide photographic element of claim 1 where the acrylate ester monomer has the formula:

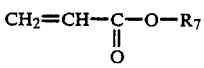

wherein $R_7$ is an alkyl or alkoxyalkyl group having from 2 to 20 carbon atoms.

6. The silver halide photographic element of claim 1 where the ethylenic monomer capable of forming hydrophilic polymers is the acryloyloxyethanesulfonic acid sodium salt, the methacryloyloxyethanesulfonic acid sodium salt, the acrylamidoethanesulfonic acid potassium salt or the methacrylamidoethanesulfonic acid potassium salt.

7. The silver halide photographic element of claim 1 where the acrylate ester monomer is butylacrylate, ethoxyethylacrylate, ethylhexylacrylate, hexylacrylate or ethylacrylate.

8. The photographic element of claim 1 where the N-L 3-oxo-alkyl-substituted acrylamide monomer is N-3-oxo1,1-dimethyl-butyl-acrylamide.

9. The photographic element of claim 1 where the inert monomers are chosen in the group consisting of the ethylenic monomers, of the styrene type monomers, of the alkenoic acid esters, of the acrylamides and of the vinyl acetate.

10. The silver halide photographic element of claim 1 where the cross-linking monomer is a monomer having at least two independently polymerizable vinyl groups.

11. The silver halide photographic element of claim 10 where the cross-linking monomer has the formula:

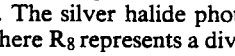

wherein $R_8$ represents a divalent organic group.

12. The silver halide photographic element of claim 11 where $R_8$ represents a divalent organic group chosen in the group consisting of:

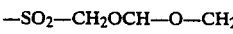

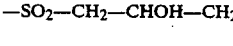

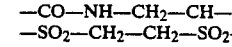

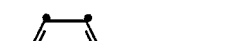

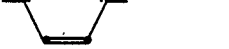

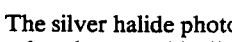

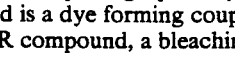

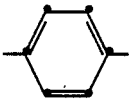

13. The silver halide photographic element of claim 1 where the photographically useful hydrophobic compound is a dye forming coupler, a UV absorbing agent, a DIR compound, a bleaching agent, an antihalo agent, a sensitizing dye, a desensitizing dye or a developing agent.

14. The silver halide photographic element of claim 1 where the weight ratio between said polymer particles and said hydrophobic compounds is comprised in the range from 1:1 to 10:1.

15. The silver halide photographic element of claim 1 where the weight ratio between hydrophilic colloid and loading polymer is comprised in the range from 1:20 to 20:1.

16. The silver halide photographic element of claim 1 wherein said ethylenic monomer is methacryloyloxyethanesulfonic acid sodium salt, said acrylamide is diacetoneacrylamide, and said acrylic acid ester monomer is n-butylacrylate.

17. A silver halide photographic element comprising a base and, coated on the base, one or more hydrophilic colloidal layers at least one of which is a silver halide emulsion layer and at least one of said hydrophilic colloidal layers containing photographically useful hydrophobic compounds loaded on loading polymer particles having an average diameter in the range from 0.02 to 0.2 micron characterized by the fact that said loading polymer for at least 70% of its weight comprises:

(a) repeating units derived from the polymerization of an ethylenic monomer containing a sulfonic or sulfonate group which monomer is capable of forming hydrophilic homopolymers, said units comprising from 0.5 to 1.5% by weight of said polymer, (b) repeating units derived from polymerization of an N-3-oxo-alkyl-substituted acrylamide having the formula

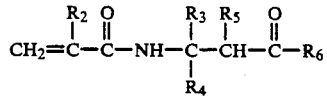

wherein $R_2$ represents hydrogen or a low alkyl group having from 1 to 4 carbon atoms, $R_3$, $R_4$, $R_5$ and $R_6$ each represents hydrogen, a low alkyl group with from 1 to 4 carbon atoms or a cycloalkyl group having a maximum of 10 carbon atoms, and (c) repeating units derived from the polymerization of acrylic acid ester monomers having a TG lower than 0° C., said units comprising at least 43.5% by weight of said polymer, the remaining weight percentage, from zero to 30%, being formed by repeating units derived from inert monomers and/or cross-linking monomers.

18. The element of claim 2 wherein said hydrophobic compounds are selected from the group consisting of dye forming couplers, UV-absorbing compounds, development inhibitor releasing compounds, bleaching agents, sensitizing dyes and developing agents.

19. The element of claim 4 wherein said hydrophobic compounds are selected from the group consisting of dye forming couplers, UV-absorbing compounds, development inhibitor releasing compounds, bleaching agents, sensitizing dyes and developing agents.

20. The element of claim 16 wherein said hydrophobic compounds are selected from the group consisting of dye forming couplers, UV-absorbing compounds, development inhibitor releasing compounds, bleaching agents, sensitizing dyes and developing agents.

21. The element of claim 16 wherein said hydrophobic compounds are selected from the group consisting of dye forming couplers, UV-absorbing compounds, development inhibitor releasing compounds, bleaching agents, sensitizing dyes and developing agents.

22. The element of claim 17 wherein said hydrophobic compounds are selected from the group consisting of dye forming couplers, UV-absorbing compounds, development inhibitor releasing compounds, bleaching agents, sensitizing dyes and developing agents.

* * * * *

UNITED STATES PATENT AND TRADEMARK OFFICE

CERTIFICATE OF CORRECTION

PATENT NO. : 4,990,435

DATED : February 5, 1991

INVENTOR(S) : Vallarino et al.

It is certified that error appears in the above-identified patent and that said Letters Patent is hereby corrected as shown below:

Col. 7, line 52, Insert --(-- before "n-"

Col. 13, line 33, Delete "L"

Signed and Sealed this

First Day of February, 1994

*Attest:*

Bruce Lehman

BRUCE LEHMAN

*Attesting Officer*

*Commissioner of Patents and Trademarks*